US005535457A

United States Patent [19]

Welsh, Jr. et al.

[11] Patent Number: 5,535,457

[45] Date of Patent: Jul. 16, 1996

[54] BLOW MOLDED CRIB

[75] Inventors: Thomas J. Welsh, Jr., Troy; John V. Mariol, Cincinnati, both of Ohio

[73] Assignee: Lisco, Inc., Tampa, Fla.

[21] Appl. No.: 334,826

[22] Filed: Nov. 4, 1994

[51] Int. Cl.[6] ..... A47D 7/02

[52] U.S. Cl. ..... 5/93.1; 5/11; 5/100; 5/907

[58] Field of Search ..... 5/93.1, 100, 11, 5/907, 280, 207, 209

[56] References Cited

U.S. PATENT DOCUMENTS

| | | | |
|---|---|---|---|
| 2,687,537 | 8/1954 | Wallace et al. | 5/280 |
| 3,535,717 | 10/1970 | Mulder | 5/93.1 |
| 3,627,251 | 12/1971 | Paulison | 5/93.1 X |
| 3,634,894 | 1/1972 | Harbison | 5/93.1 X |
| 3,900,907 | 8/1975 | Mulder | 5/93.1 X |
| 4,924,539 | 5/1990 | Benoit | 5/100 |

FOREIGN PATENT DOCUMENTS

| | | | |
|---|---|---|---|
| 197805 | 5/1975 | Germany | 5/280 |

*Primary Examiner*—Michael F. Trettel

[57] ABSTRACT

A crib comprising a blow molded headboard panel vertically positioned and constituting the head end of the crib. A blow molded footboard panel is vertically positioned and constitutes the foot end of the crib with the footboard being essentially parallel with the headboard and with a space therebetween. A pair of blow molded side panels are provided with each of the side panels vertically positioned and spaced in parallel relationship with respect to each other and with the ends of the side panels removably coupled with respect to the ends of the headboard and footboard to form a generally box-like configuration.

14 Claims, 12 Drawing Sheets

BLOW MOLDED CRIB

BACKGROUND OF THE INVENTION

1. Field of the Invention

This application relates to a blow molded crib and, more particularly, to a crib fabricated of four blow molded side panels with the operating mechanisms encased within one of the panels and with additional features for greater safety, increased convenience, superior esthetics and cost reductions.

2. Description of the Background Art

In the field of juvenile furniture, it has been found that cribs are one of the more indispensable items. Cribs have taken a large variety of designs and configurations over the years. Their fabrications have traditionally been of wood, then metal, and more recently of plastic and/or with significantly increasing numbers of plastic parts with some metal components. Plastic cribs and crib components have been traditionally fabricated through an injection molding process wherein the cross-sectional configuration of the various components is generally planar with, in many instances, curved edges for structural integrity. The technology of blow molding is seldom utilized for large structural panels, never as the headboard, footboard and side panels of cribs.

It has been found that the use of blow molding technology as a crib fabrication technique allows for increased safety by allowing the operating components to be encased within cylindrical parts of the blow molded components, a location out of the way from the accidental pinching of fingers or other parts of an infant or small child occupying the crib, or even the care provider. This is accomplished in association with significant other benefits such as improved mechanisms for adjusting the height of the side rail and the mattress, improved teething elements as an integral part of the rail, decorative designs including removable panels and simplified fabrication assembly and adjustment techniques.

DESCRIPTION OF THE BACKGROUND ART

Many types of cribs are known and are in wide use today throughout the juvenile furniture industry. Such cribs are fabricated of a wide variety of materials, through a wide variety of processes, and feature a wide variety of beneficial design features. Typical examples of such cribs are described in the patent literature. No prior art crib, however, features the design capabilities of the present invention.

Accordingly, it is an object of the present invention to fabricate a crib by blow molding.

A further object of the invention is to encase the side panel height adjustment mechanisms of a crib within hollow panels.

A further object of the present invention is to simplify the operating mechanism for the raising and lowering of a crib side panel.

A further object of the present invention is to render the raising and lowering of a crib mattress support a safer and more convenient process.

A further object of the present invention is to integrally mold teething elements into the top rail of a crib side panel.

A further object of the present invention is to decorate the various headboard, footboard and side panels of a crib directly during fabrication and/or through the use of supplemental components over selected areas of the panels.

A further object of the present invention is to simplify the assembly of cribs through a minimum number of interconnected and/or moving parts while minimizing the danger normally attendant with the interconnecting and/or moving of such parts.

It is a further object of the present invention to maximize the safety of cribs both for the infant or child user as well as the adult care provider particularly during the raising and/or lowering of a side panel.

It is a further object of the present invention to provide a crib comprising a blow molded headboard panel vertically positioned and constituting the head end of the crib. A blow molded footboard panel is vertically positioned and constitutes the foot end of the crib with the footboard being essentially parallel with the headboard and with a space therebetween. A pair of blow molded side panels are provided with each of the side panels vertically positioned and spaced in parallel relationship with respect to each other and with the ends of the side panels removably coupled with respect to the ends of the headboard and footboard to form a generally box-like configuration.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention many be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention may be incorporated into a new and improved crib comprising, in combination, a blow molded headboard panel vertically positioned and constituting the head end of the crib. A blow molded footboard panel is vertically positioned and constitutes the foot end of the crib with the footboard being essentially parallel with the headboard and with a space therebetween. Further provided is a pair of blow molded side panels with each of the side panels vertically positioned and spaced in parallel relationship with respect to each other and with the ends of the side panels removably coupled with respect to the ends of the headboard and footboard to form a generally box-like configuration and with each of the panels being fabricated by blow molding to form a generally horizontal upper hollow component and a generally horizontal lower hollow component and a plurality of generally vertical hollow components coupling the upper and lower components and with the space within the components in communication one with another. A plurality of integrally molded projections extend upwardly from the upper components of the side panels and constitute a teething surface for a child within the crib. Adjustment components are located within the upper component of at least one of the side panels and extend downwardly through one vertical component at the end of the side panel with a latch positionable between a retracted position within such vertical component and an extended position exterior thereof for coupling with apertures in the adjacent headboard and footboard panels. A projection extends laterally outwardly from the opposed vertical edges of at least one of the side rail panels and an associated channel is formed in the vertical edges of the adjacent end panels. The recess is formed with vertical spaces of a length less than the vertical length of the projection. Further provided is a horizontally positioned mattress support with mechanisms for raising and lowering the height of the mattress support. Such mechanisms includes vertical members of a resilient material positionable in a vertical orientation secured at their upper edges to the headboards and footboards member with each vertical member having an inwardly directed projection positionable in any of a plurality of apertures in the headboards and footboards with a keeper member vertically slidable along at least a portion of the length of the vertical member whereby when in the lower position it will maintain its associated projection in an associated aperture and when in the raised position it will allow the flexing of the resilient member to withdraw the projection from its associated aperture to allow sliding of the keeper member and mattress support to any of a plurality of elevational orientations corresponding to the aperture receiving the projection.

The foregoing has outlined rather broadly, the more pertinent and important features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

Similar reference numerals refer to similar parts throughout the several Figures.

DETAILED DESCRIPTION OF THE PREFERRED EMBODIMENT OF THE INVENTION

Figure 1:
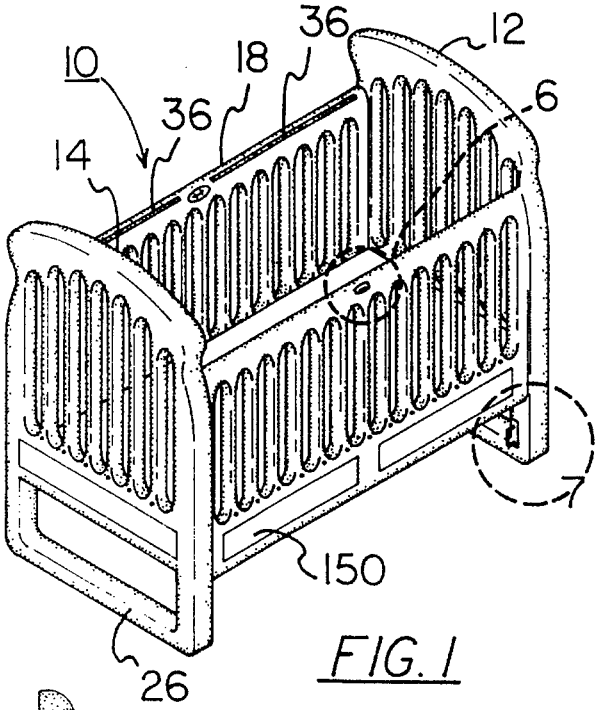
FIG. 1 is a perspective illustration of the new and improved blow molded crib constructed in accordance with the principles of the present invention.
Figure 6:
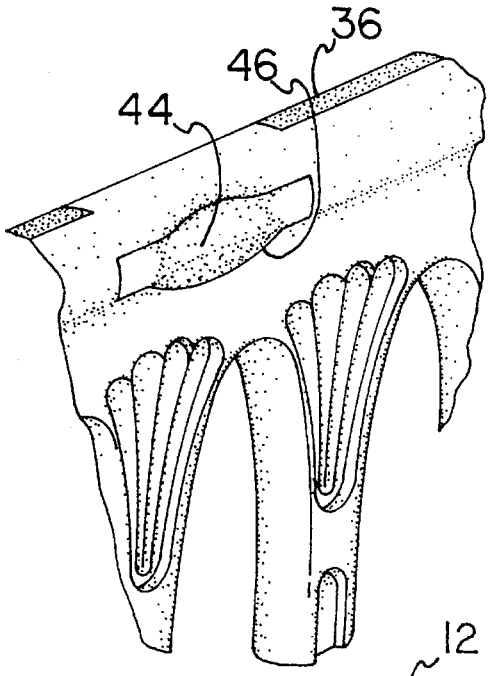
FIG. 6 is an enlarged perspective view of a portion of the upper rail and the handle for raising and lowering the associated side panels taken within circle 6 of FIG. 1.
Figure 2:
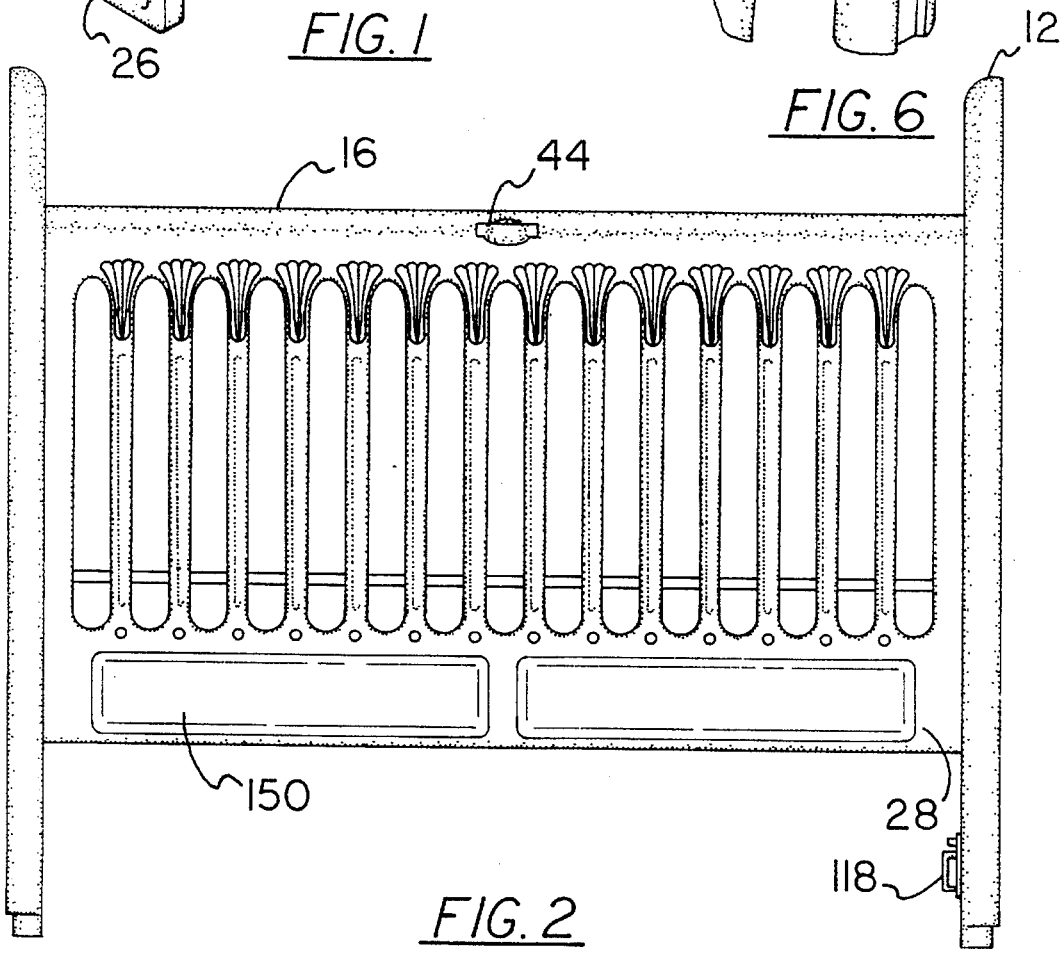
FIGS. 2 and 3 are side elevational views of the crib shown in FIG. 1.

With reference now to the drawings, and in particular to FIG. 1 thereof, a new and improved blow molded crib embodying the principles and concepts of the present invention and generally designated by the reference numeral 10 will be described.

The present invention, the new and improved blow molded crib, is comprised of a plurality of components. Such components in their broadest context include a headboard panel, a footboard panel, a pair of side panels, teething projections integrally formed in the upper extent of the side rails, side panel adjustment components located within tubular components of the side panels, a projection extending outwardly from the side edges of the side panels for adjustably coupling with the headboard and footboard for height adjustment purposes, and a horizontally positionable mattress support. Such components are individually configured and correlated with respect to each other so as to attain the desired objective.

More specifically, the crib 10 is fabricated of four major components. The first major component is a blow molded headboard panel 12. Such headboard panel is vertically positioned and constitutes the head end of the crib. Next provided is a blow molded footboard panel 14. Such footboard panel is vertically positioned and constitutes the foot end of the crib. The footboard is essentially parallel with the headboard. They are located with a space therebetween. Located within such space is a pair of blow molded side panels 16 and 18. Each of the side panels is vertically positioned and spaced in parallel relationship with respect to each other. They are positioned so that the ends of the side panels are in proximity to, and may removably couple with respect to, the ends of the headboard and footboard. As such, the headboard and footboard panels as well as the sideboard panels form a generally box-like configuration.

Each of the panels is fabricated by blow molding to form horizontal upper hollow components 22 and 24 and horizontal lower components 26 and 28. Therebetween are a plurality of vertical hollow components 30 and 32 coupling the upper and lower components. The space within the components is in communication one with another for any one of the panel components.

Figure 11:
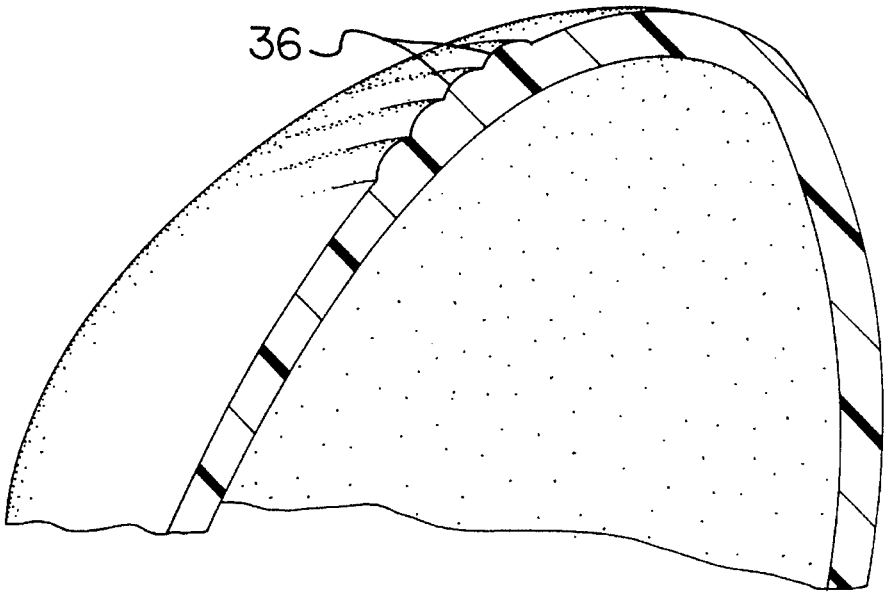
FIG. 11 is a cross sectional view taken through the upper extent of one of the side rails.

Located upon the upper horizontal component 24 of each side panel are a plurality of integrally molded projections 36. Such projections extend upwardly from the upper component of the side panels and extend to the side thereof facing the interior of the crib. Such projections constitute a teething surface for a child within the crib. As can be seen in FIG. 11, a cross sectional view of a upper extent of the side rail, the walls of the panels are nominally about one hundred thousands of an inch (0.100 inches), plus or minus about ten percent. The projections are spherical with a radius of about 0.090 inches plus or minus 10 percent and extend upwardly about 0.020 inches plus or minus 10 percent. They are positioned in a symmetric pattern and extend for and arc from about the top most position of the side rail and circumscribe an arc of about forty-five degrees. They extend along essentially the entire length of the upper rail of the crib side panels except at the handles. In the preferred embodiment, the preferred material for the injection molding of the crib is high molecular weight polyethylene (HMWPE). The preferred specific type of HMWPE is fabricated, manufactured and marketed by PHILLIPS PETROLEUM COMPANY, INC. of Bartlesville, Okla.

The hollow components 30 of the side rails are of such size as to house and encase the drop side rail adjustment components 40 for allowing at least one of the side panels 16 to be raised and lowered and maintained at a raised or lowered position or any of a plurality of positions therebetween. Such components include a horizontal rod 42 within the upper horizontal component 24 of at least one of the side panels 16. Such rod 42 has a square cross sectional configuration and is provided at its central extent with a thumb piece or handle 44 for being depressed by the user in adjusting the height of the side panel. Such handle is positioned within an opening 46 of the side panel. Each end 48 of the rod is formed with a teardrop-shaped holder 50 with a central opening 52 for being supported on the end of the rod.

The radial remote extent of the holder 50 is rotatable with the rotation of the rod 42 and is provided with an aperture 54 adapted to swing in an arc-like configuration of about 45 degrees when the thumb piece is fully depressed. This will function to raise the remote aperture 50 about one-half of an inch.

Figure 12:
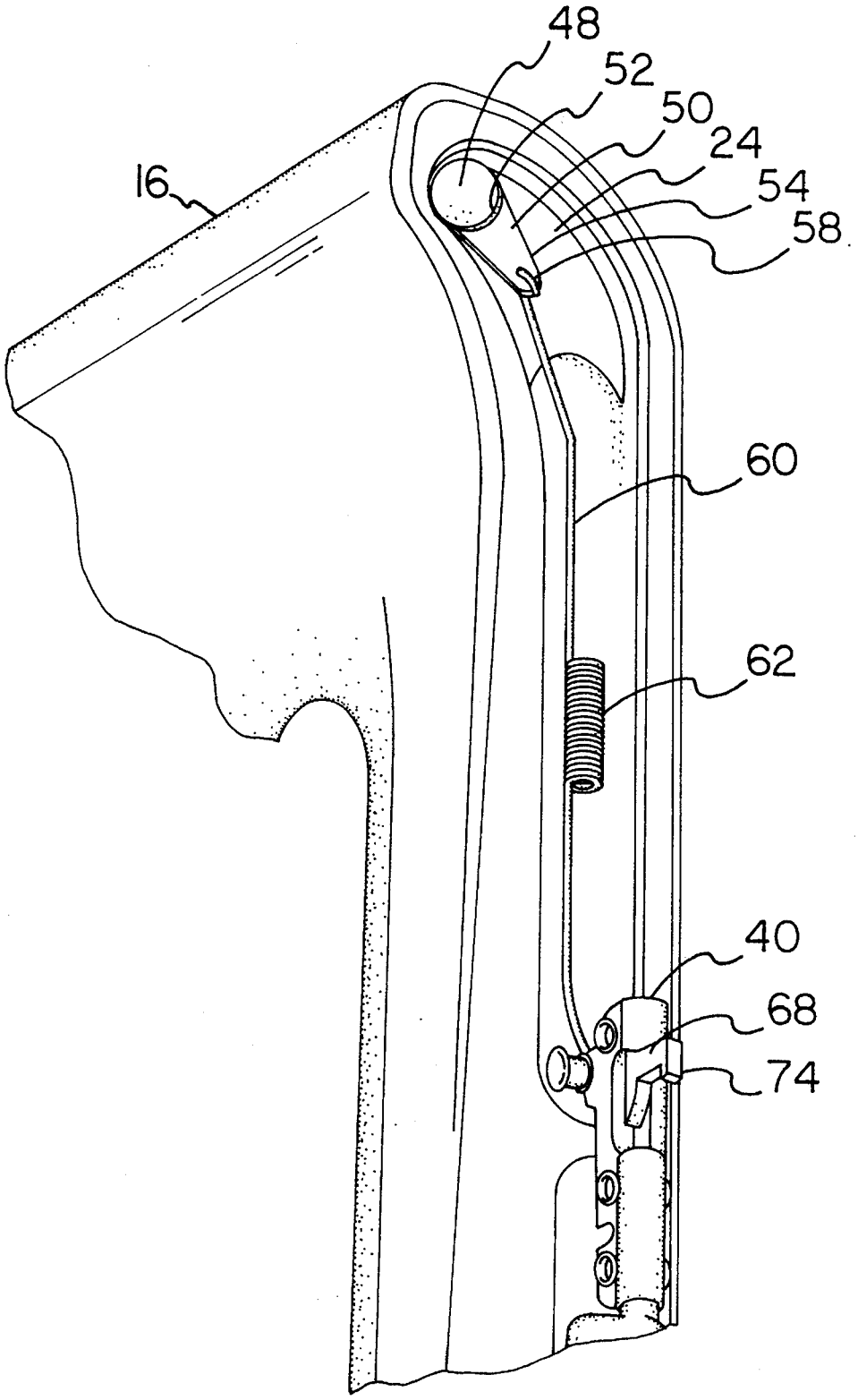
FIG. 12 is a perspective view of a portion at one end of a side rail with parts broken away to show certain internal constructions thereof.
Figure 13:
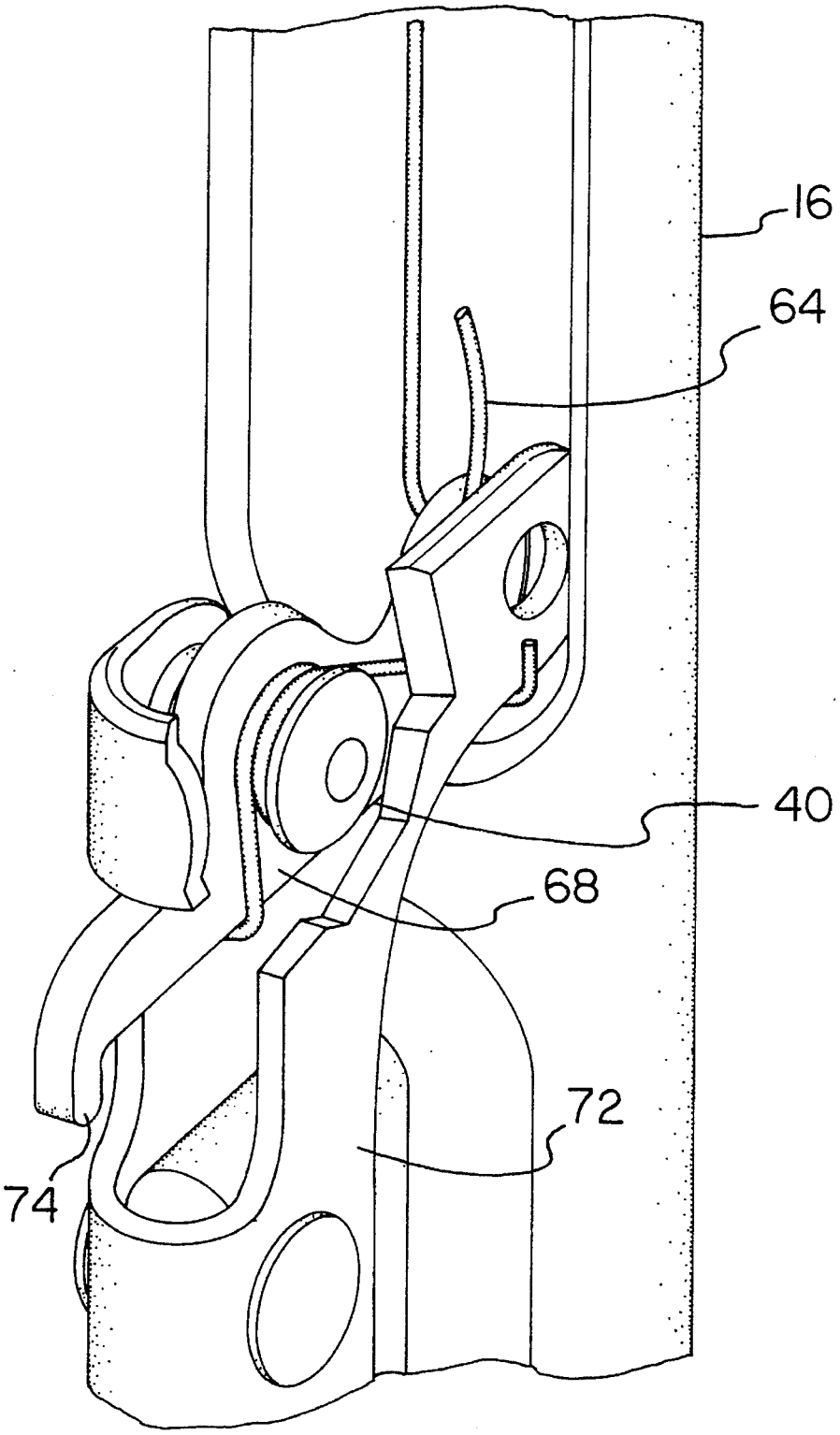
FIG. 13 is an enlarged perspective view of the latching mechanism shown in FIG. 12.
Figure 14:
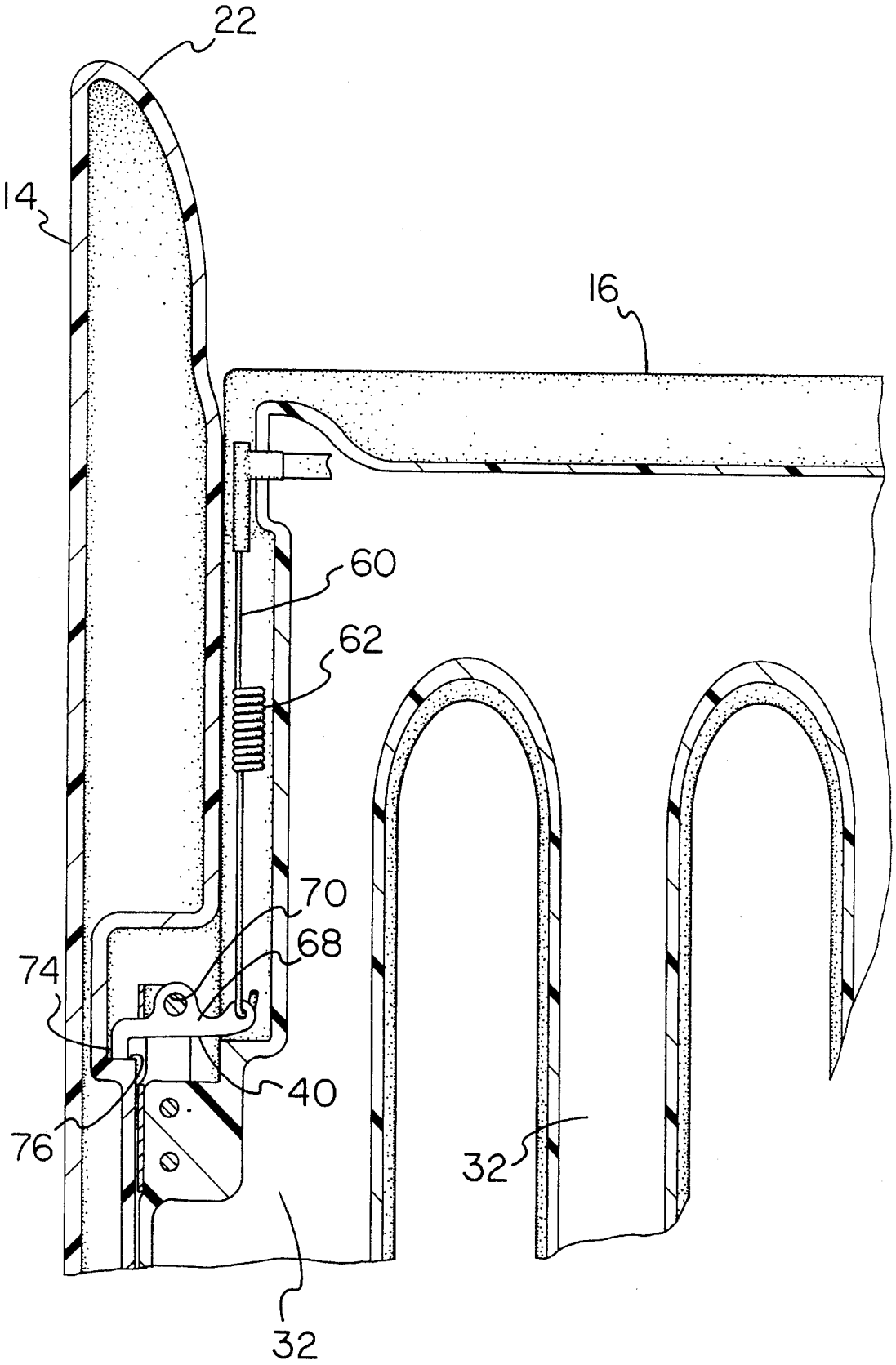
FIG. 14 is a cross section view showing in greater detail the locking mechanisms shown in FIG. 12 and 13.
Figure 18:
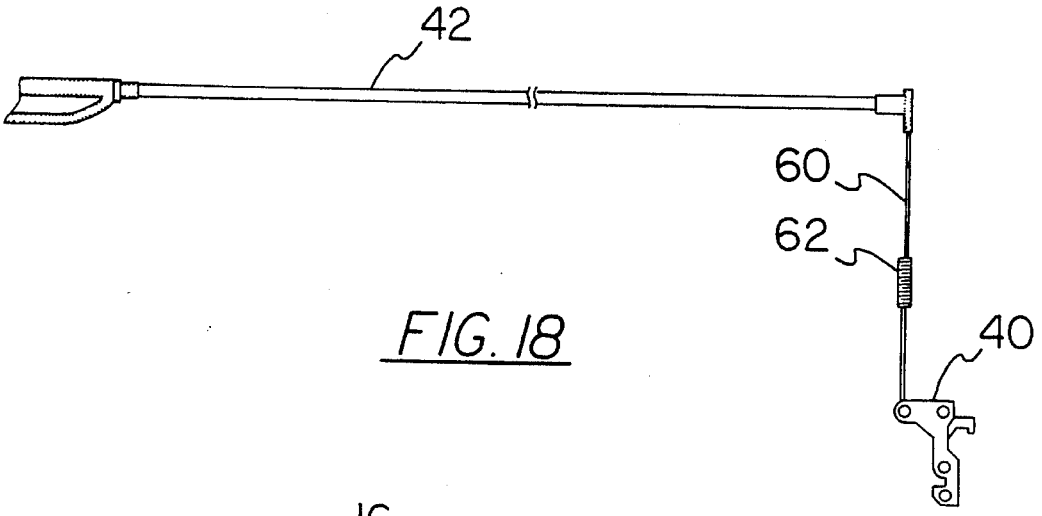
FIG. 18 is a front elevational view of the side rail handle, rotatable rod and associated latching mechanisms.

Secured to the remote aperture 50 is a loop 58 in the upper end of a actuation wire 60. The actuation wire 60 is relatively stiff with a coil spring 62 formed at an intermediate extent thereof. The lower extent of the wire is formed with a loop 64 coupled to adjustment components 30. The adjustment components 30 are best seen in FIGS. 12, 13 and 14 and include a rotatable L-shaped plate 68. The L-shaped plate is formed with a central pivot aperture 70 mounted in a housing 72 for rotatable movement in response to movement of the handle 44. The exterior extent of the L-shaped member has secured thereto the support finger 74 which, by the raising and lowering of the wire 60, will pivot such finger from a horizontal locked position within a predetermined vertical slot 76 in the end panel to a lowered position out of such slot at which orientation the side panel is free to be moved by the user upwardly or downwardly. The side panel must first be lifted to disengage the finger from the slot 76 to abate the possibility of inadvertent dropping of the side panel.

The guiding of the movement of a side panel 16 upwardly or downwardly is ensured through a vertically extending recess 80 formed at each side of the headboard and footboard. This is in association with a vertically extending lateral projection 82 at the ends of the end panels 12 and 14. Coupling therebetween is simply by inserting the projection 82 into the recess 80. Such recesses do not extend the entire length of the headboard and footboard panels. Rather, they are at spaced locations. The space 84 between such recesses 80 is of a distance less than the height of the projection to ensure that the projection does not inadvertently separate from the recesses during operation and use. The spaces are formed as is necessary during the blow molding fabrication technique to allow fabrication of the recesses but the removal of such headboard and footboard panel from the mold.

Figure 8:
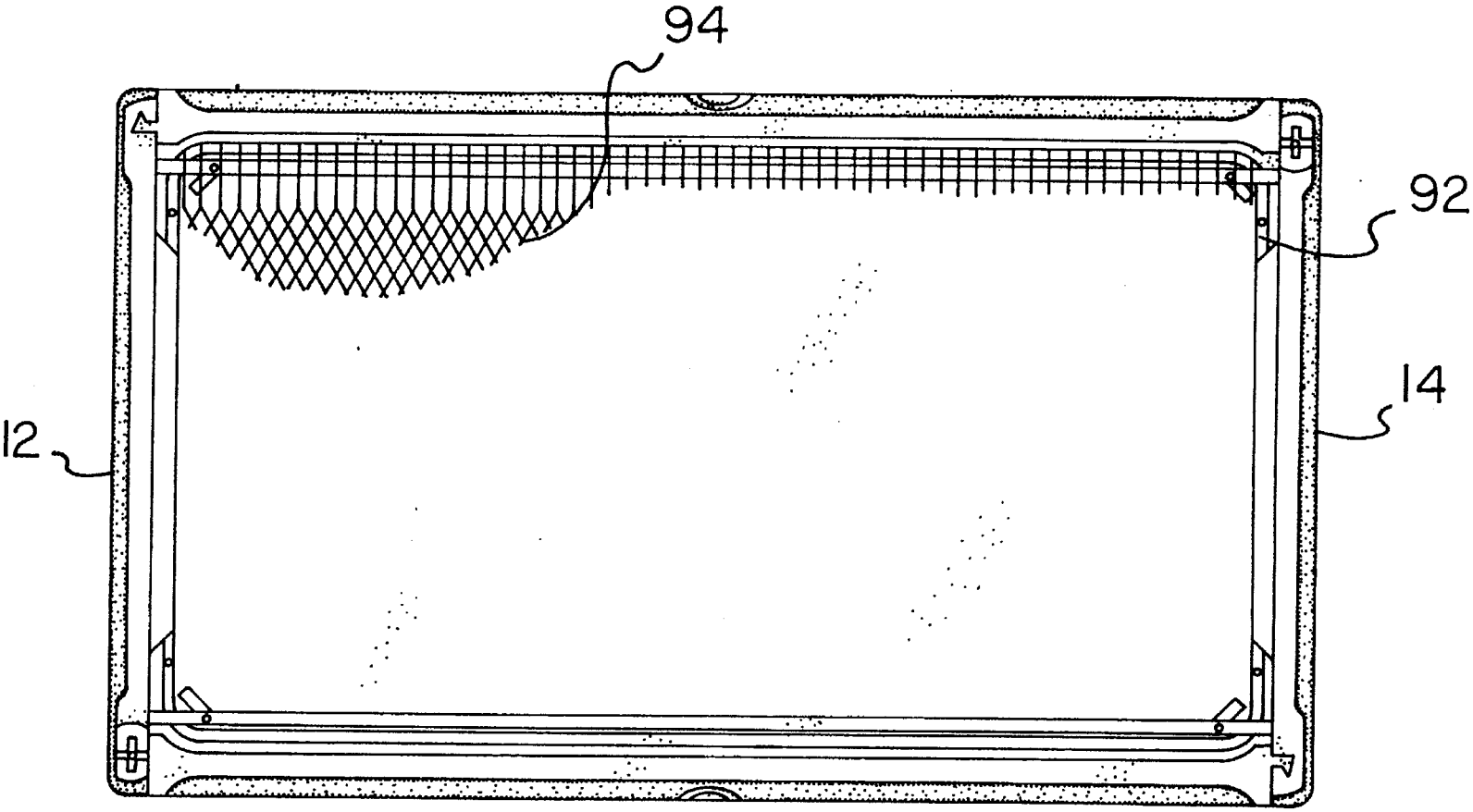
FIG. 8 is a bottom view of the crib shown in FIG. 1.
Figure 9:
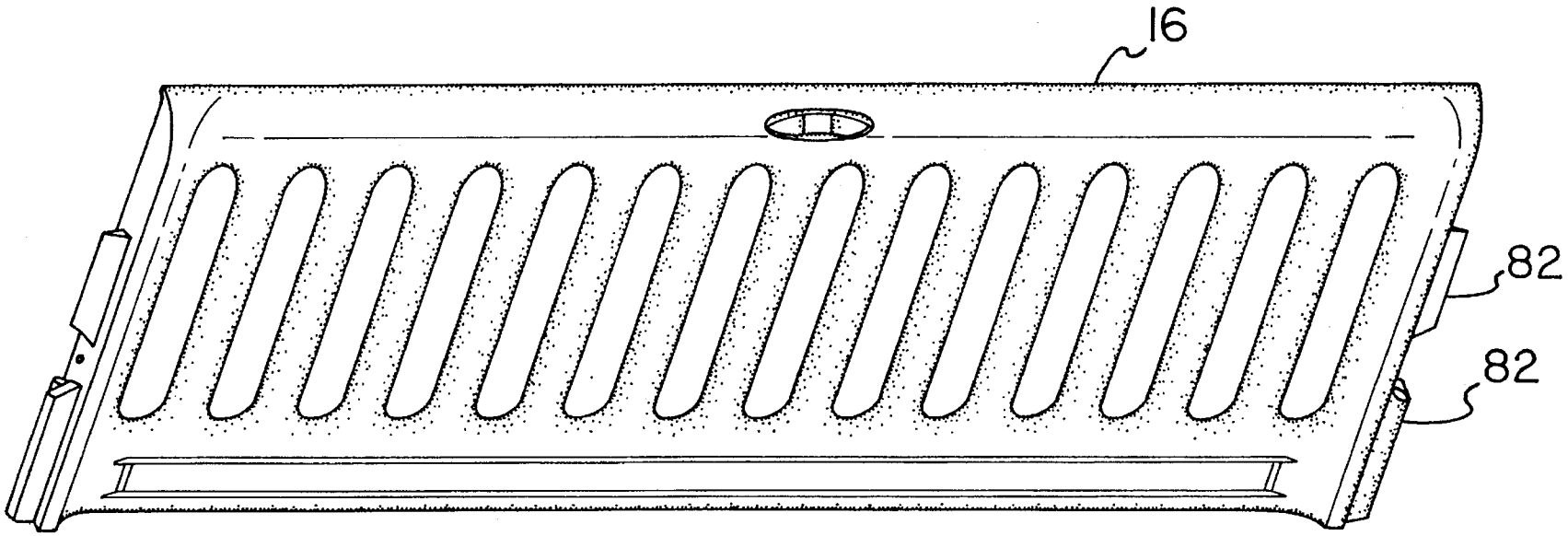
FIG. 9 is a perspective illustration of one of the side rails of the prior Figures.
Figure 20:
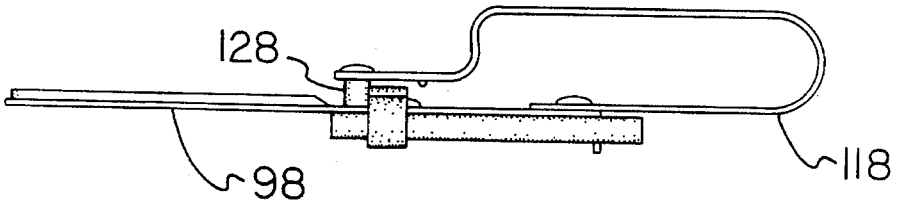
FIG. 20 is a side elevational view of the elements shown in FIG. 19 but with such parts assembled.
Figure 19:
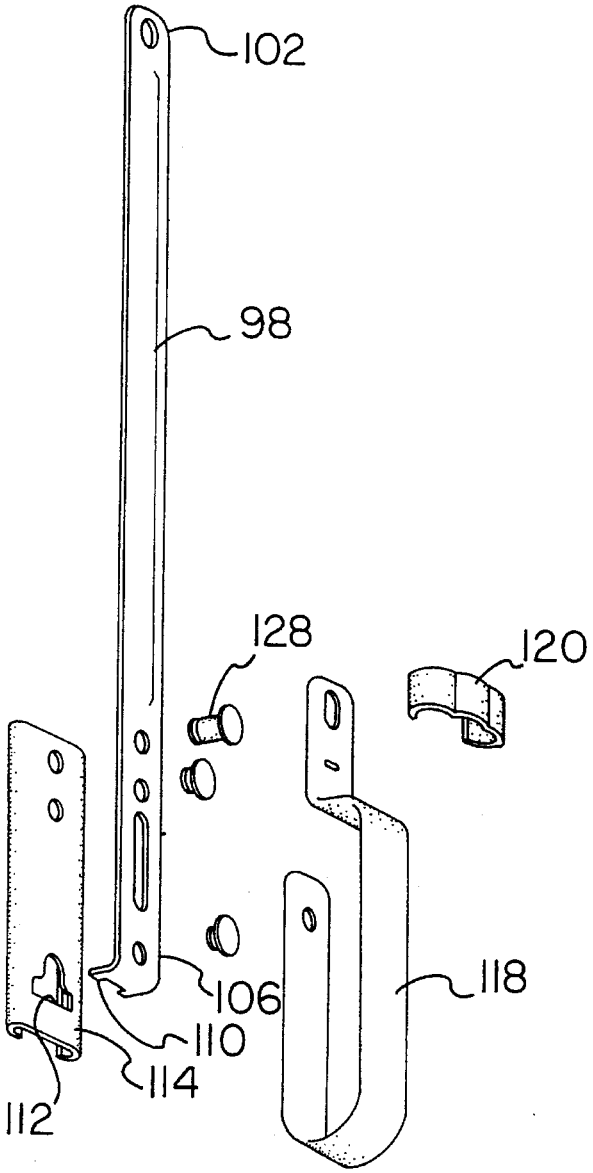
FIG. 19 is an exploded perspective view of the crib height adjustment mechanisms shown in FIGS. 1, 3 and 7.

The next major component of the system 10 of the present invention is the mattress support 88 and associated adjustment mechanism 90. Note FIGS. 8, 19 and 20. The mattress support includes a rigid rectangular member 92 constituting a periphery of the mattress support. A wire mesh 94 spans the periphery of the support for receiving the mattress thereon. The peripheral rectangular member 92 has at its corners adjacent to the headboard and footboard panels an aperture 96 for being secured to the upper end of a resilient or spring-like plate 98. Such plate 98 is preferably fabricated of a metallic material so that when secured in position at its upper end 102 as by a rivet 104, the lower end 106 may be flexed away from its normal vertical position to a withdrawn orientation.

The lower end 106 of the resilient member 98 is provided with an outwardly facing projection 110. Such projection is adapted to be received in one of a plurality of vertically aligned apertures 112 of similar size and shape formed in a bracket 114. Four such brackets are provided, two on the headboard and two on the footboard. They are on the interior face thereof so as to preclude inadvertent exposure.

Figure 7:
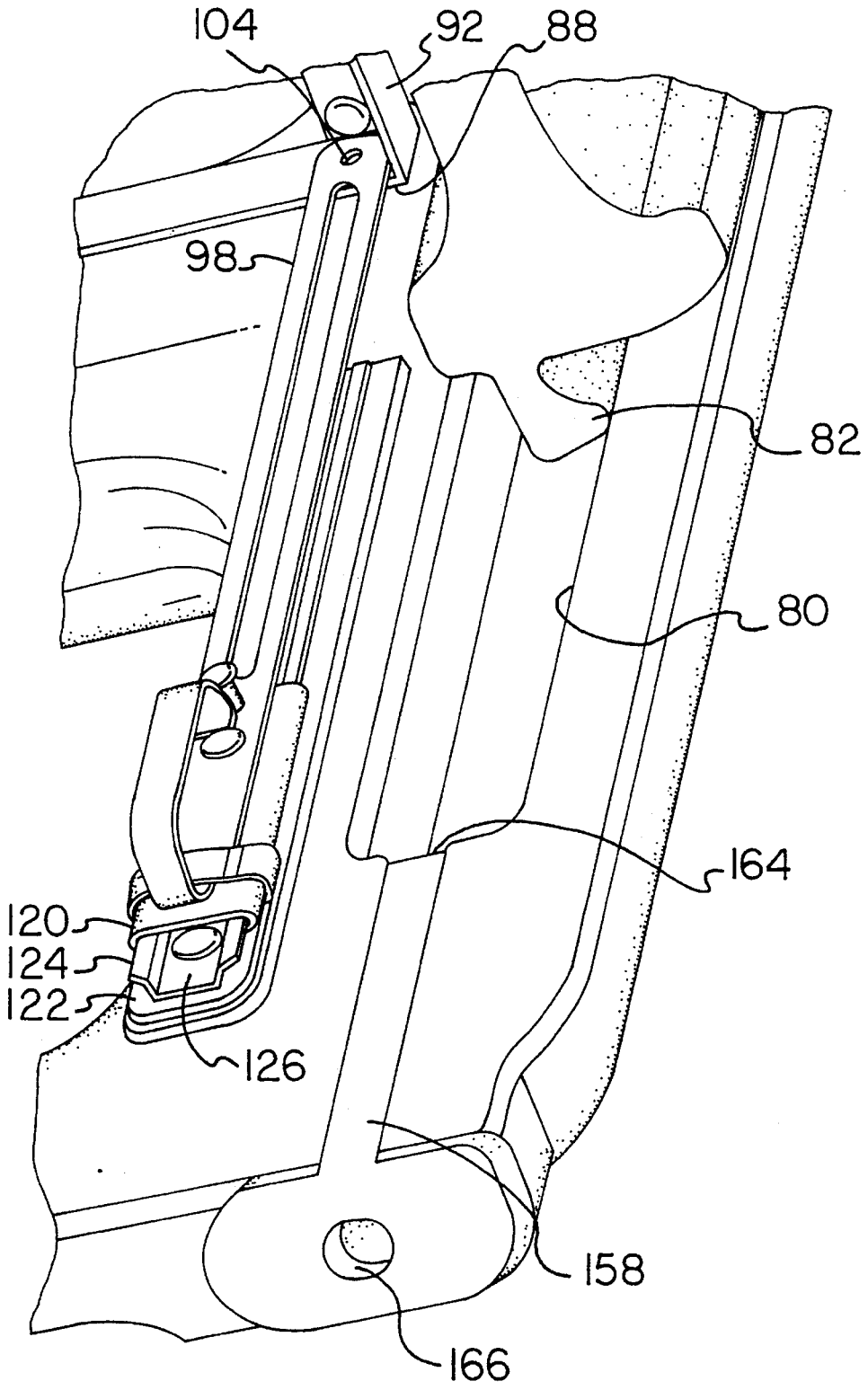
FIG. 7 is an enlarged perspective view of a portion of the lower extent of the side rail and an end rail taken within circle 7 of FIG. 1.

On the side of each resilient plate 98 is an upturned extent riveted to such plate constituting a handle 118 for being grasped by the user. Such handle is for pulling the resilient member outwardly and the projection out of its associated aperture. Inadvertent separation of the projection from its associated aperture is effected through a C-shaped keeper 120. Such keeper is of a rigid material in a configuration to encompass the lower extent of the resilient member and slide upwardly and downwardly with respect thereto. The interior ends of the keeper are free and are received in a space 122 between the raised vertical edges 124 of the support plate 126 and the portion of the headboard and footboard thereadjacent. Note FIG. 7. Lastly, a pin 128 extends rearwardly from each resilient member to limit the extent of the upward movement of the keeper.

In this manner, when in the raised position, the flexing of the resilient member will function to withdraw the projection from its associated aperture to allow the sliding of the keeper member and mattress support to any of a plurality of elevational orientations corresponding to the aperture received in the projection.

Figure 15:
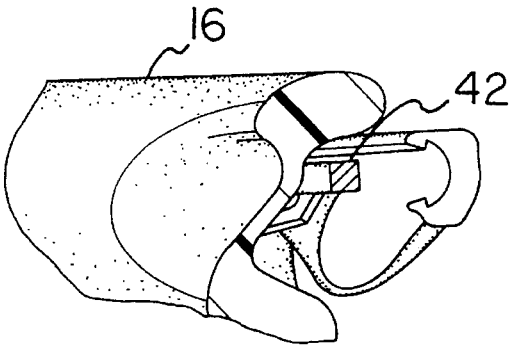
FIG. 15 is a view similar to that shown in FIG. 12 but illustrating the coupling of the rotatable rod to the side rail handle.
Figure 16:
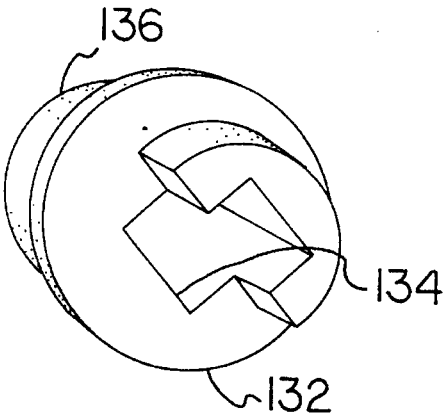
FIG. 16 is a perspective view of one of the items of hardware utilized at the end of the rotatable rod for coupling with the associated wire.
Figure 17:
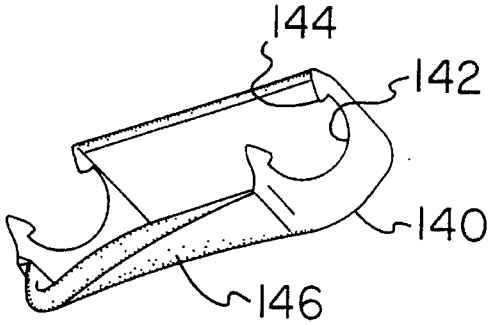
FIG. 17 is a perspective view of another item of hardware shown in FIG. 15 for coupling the rotatable rod with the handle of the side rails.

FIGS. 15, 16 and 17 show in greater detail some of the hardware associated with the rotatable rod 42. Such hardware includes an end cap 132 positionable at the opposite ends of the rotatable rod 42. An aperture 134 extends axially therethrough and is formed with a square cross sectional configuration. This is for receiving the rod during operation and use. The exterior surface 136 receives the teardrop-shaped member 50 for raising and lowering the wire 60. An additional piece of hardware is the central support 140 positionable on a central extent of the rod 42. Such member has a recess 142 with projections 144 on the opposite sides thereof. This is for proper mounting and retention on the rod 42 during operation and use. One surface 146 of such component 140 constitutes the handle of the device.

Figure 4:
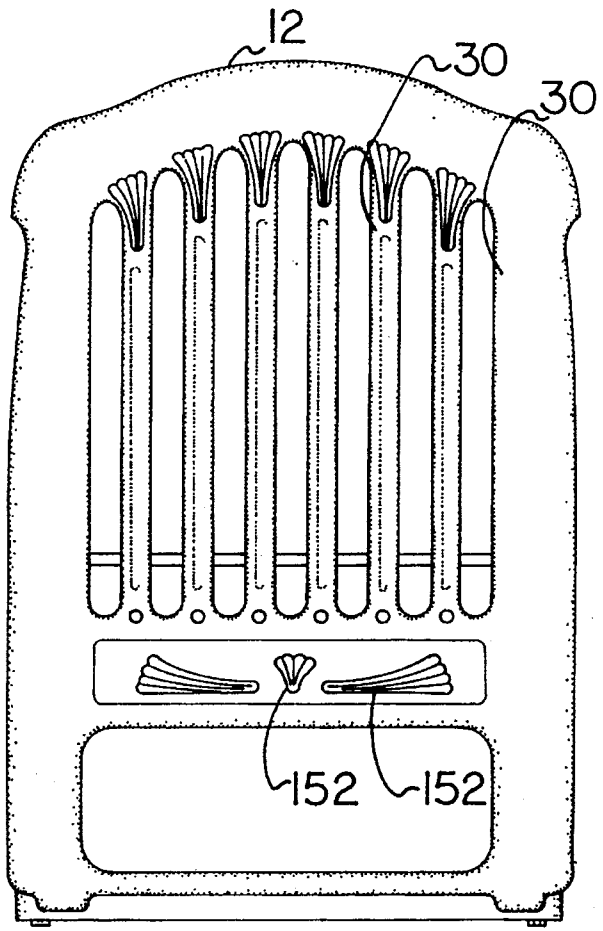
FIGS. 4 and 5 are end elevational views of the crib shown in FIG. 1.
Figure 3:
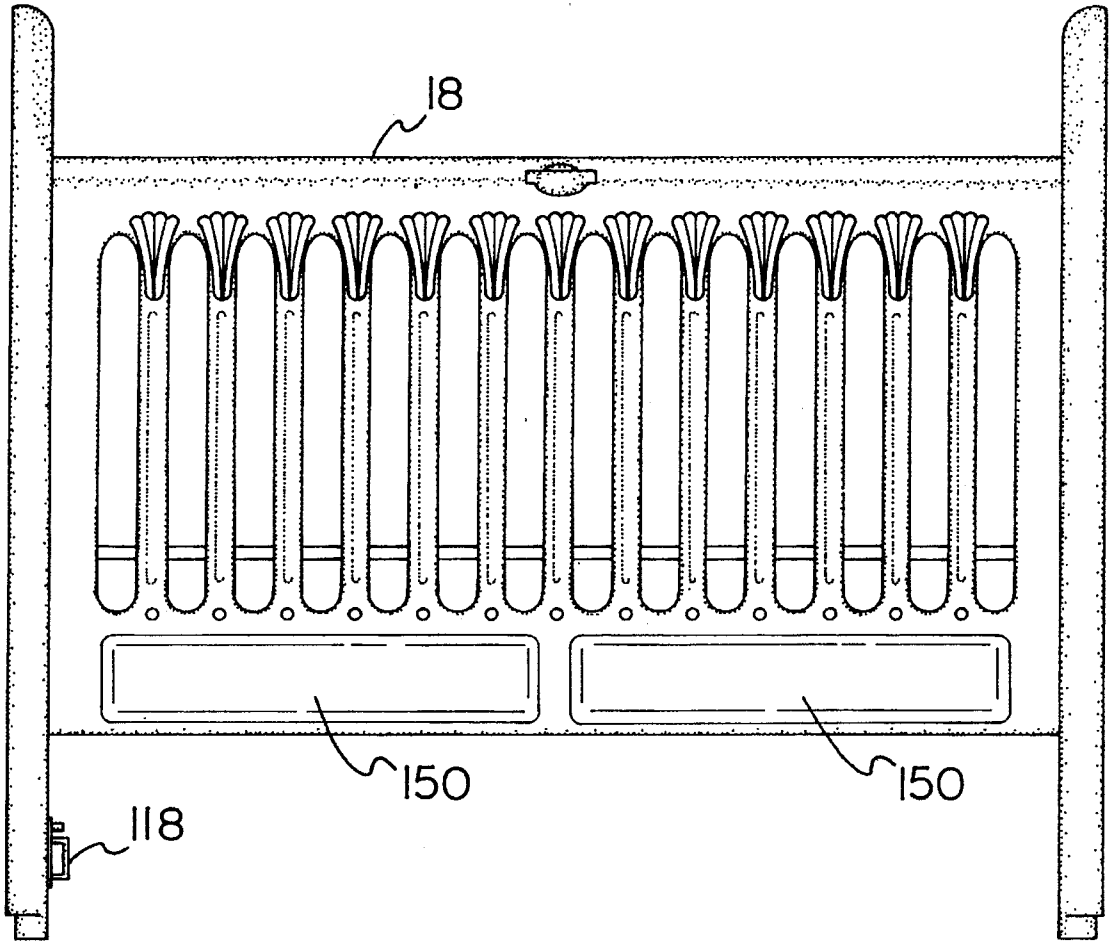
Figure 5:
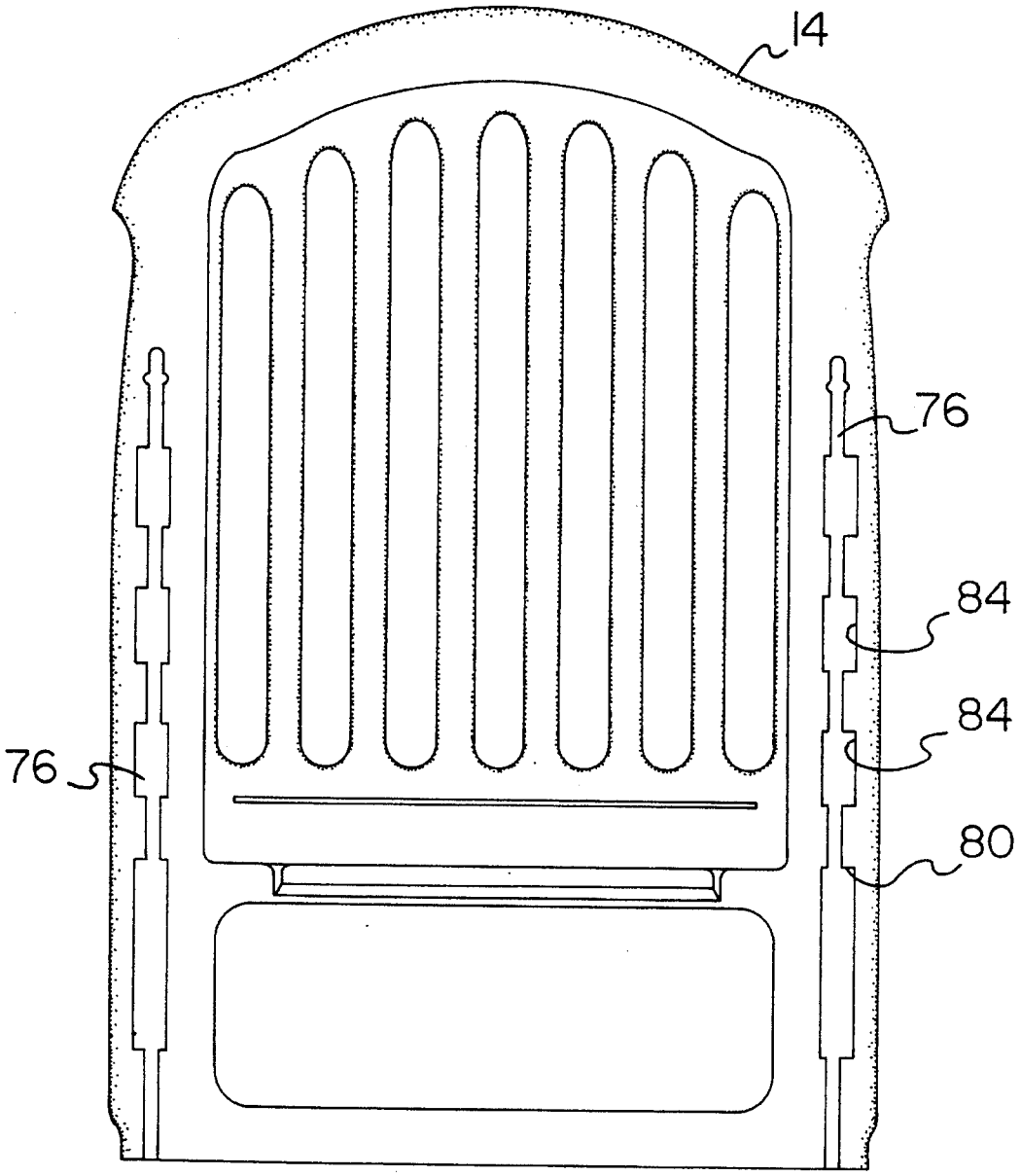
Figure 10:
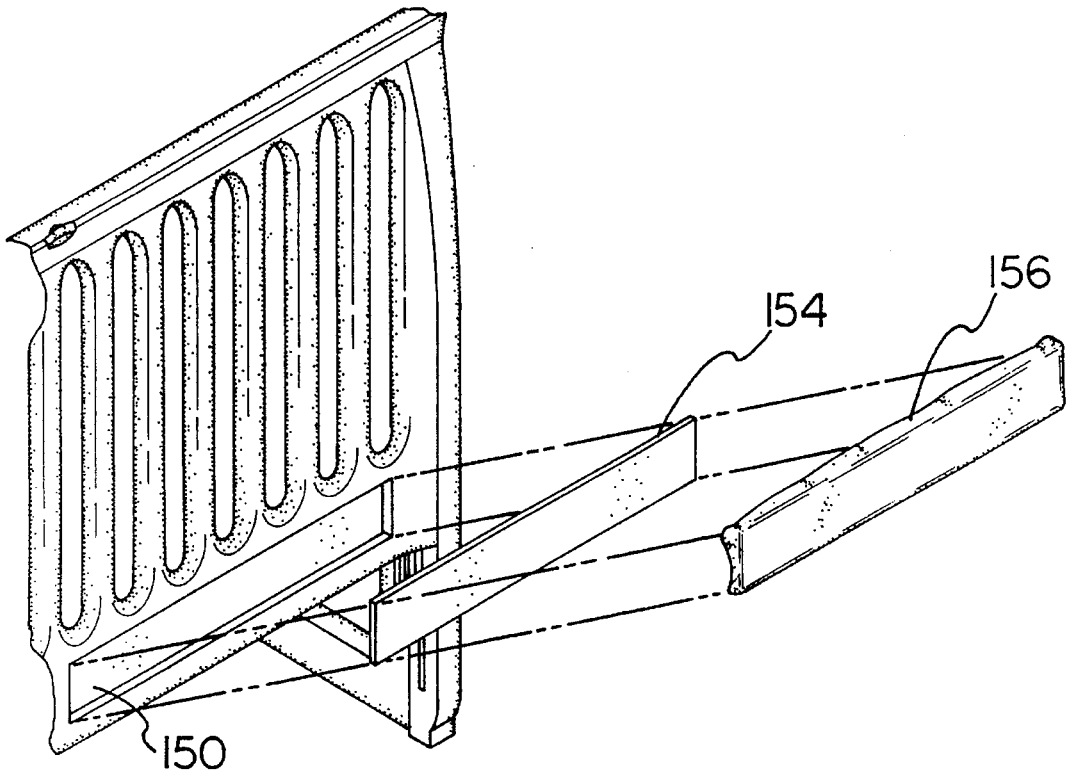
FIG. 10 is an enlarged perspective view of a portion of one of the side panels with a decorative insert panel shown in an exploded configuration.

Esthetics are preferably enhanced by having a plurality of rectangular recessed regions 150 on the various panels. Such panels may be plane but are preferably formed with some sort embossed indicia 152 formed during the blow molding fabrication process. Such indicia may be in one or more of the panels 150. In addition, there is preferably provided with the crib an insert block 154 adapted to be press-fit into the recesses 150. They are of such size that the blocks 154 may be covered with a designer fabric 156 of a user's preference. Then the insert 154 and fabric will remain within the recess 150 in which it is located. This is to add an air of distinctiveness to the various cribs. Note FIGS. 4 and 10.

Figure 21:
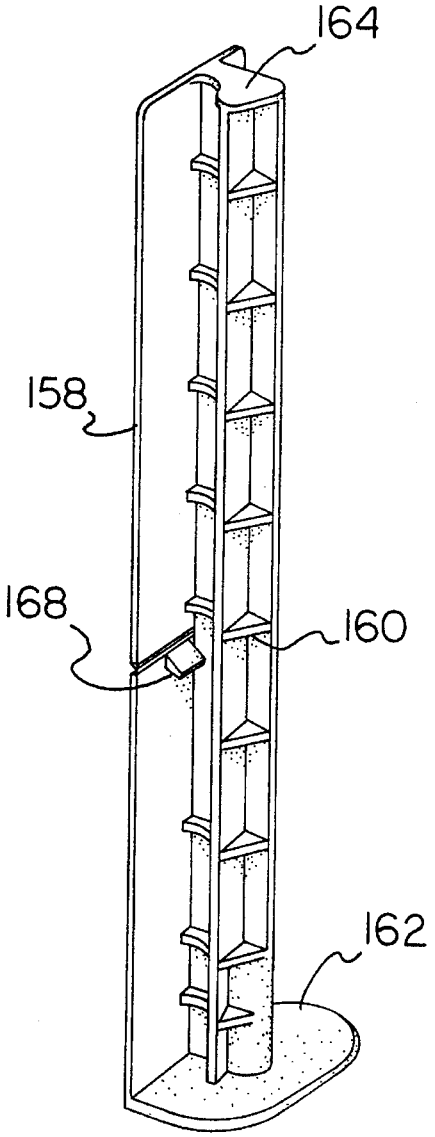
FIG. 21 is a perspective illustration of one of the caster supports shown in FIGS. 7, 8 and other various views.

The last component of the system is the caster block 158. This can be seen in FIGS. 7 and 21. Such block is force-fit into the aperture at the lower end of the end rails 12 and 14. They are molded parts with planar surfaces and strengthening ribs 160 along their length. A lower plate 162 is at the lower end and a plate 164 is at the upper end. The lower plate 162 has an aperture 166 for receiving the upstanding rod of a conventional caster in the normal manner. A finger 168 extends inwardly for securement purposes. The upper surface 164 represents the lowermost extent to which the drop-side panel may be lowered. If the crib is to be of a two-drop-side configuration, all of the caster inserts 158 would be of the same height, a relatively short height of about 4½ inches. In those instances were the drop-side is to be fixed at an elevated orientation, the caster insert is of an elevated orientation of about 10 inches. One final feature which enhances the appearance and operability of the blow molded crib is the hollow nature with but one small blow hole for fabrication centrally located in the lowermost extent of each panel.

The present disclosure includes that contained in the appended claims as well as that of the foregoing description. Although this invention has been described in its preferred form with a certain degree of particularity, it should be understood that the present disclosure of the preferred form has been made only by way of example and that numerous changes in the details of construction and combination and arrangement of parts may be resorted to without departing from the spirit and scope of the invention.

Now that the invention has been described,

We claim:

1. A new and improved crib comprising, in combination:

a blow molded headboard panel vertically positioned and constituting the head end of the crib, a blow molded footboard panel vertically positioned and constituting the foot end of the crib with the footboard being essentially parallel with the headboard and with a space therebetween, a pair of blow molded side panels with each of the side panels vertically positioned and spaced in parallel relationship with respect to each other and with the ends of the side panels removably coupled with respect to the ends of the headboard and footboard to form a generally box-like configuration and with each of the panels being fabricated by blow molding to form a generally horizontal upper hollow component and a generally horizontal lower hollow component and a plurality of generally vertical hollow components coupling the upper and lower components and with the space within the components in communication one with another;

a plurality of integrally molded projections extending upwardly from the upper components of the side panels constituting a teething surface for a child within the crib;

adjustment components located within the upper component of at least one of the side panels and extending downwardly through one vertical component at the end of the side panel with a latch positionable between a retracted position within such vertical component and an extended position exterior thereof for coupling with apertures in the adjacent headboard and footboard panels;

a projection extending laterally outwardly from the opposed vertical edges of at least one of the side rail panels and an associated channel formed in the vertical edges of the adjacent end panels, the recess being formed with vertical spaces of a length less than the vertical length of the projection; and a horizontally positioned mattress support with mechanisms for raising and lowering the height of the mattress support, such mechanisms including vertical members of a resilient material positionable in a vertical orientation secured at their upper edges to the headboards and footboards member with each vertical member having an inwardly directed projection positionable in any of a plurality of apertures in the headboards and footboards with a keeper member vertically slidable along at least a portion of the length of the vertical member whereby when in the lower position it will maintain its associated projection in an associated aperture and when in the raised position it will allow the flexing of the resilient member to withdraw the projection from its associated aperture to allow sliding of the keeper member and mattress support to any of a plurality of elevational orientations corresponding to the aperture receiving the projection.

2. A crib comprising:

a blow molded headboard panel vertically positioned and constituting the head end of the crib;

a blow molded footboard panel vertically positioned and constituting the foot end of the crib with the footboard being essentially parallel with the headboard and with a space therebetween; and a pair of blow molded side panels with each of the side panels vertically positioned and spaced in parallel relationship with respect to each other and with the ends of the side panels removably coupled with respect to the ends of the headboard and footboard to form a generally box-like configuration and with each of the panels being fabricated by blow molding to form a horizontal upper hollow component and a horizontal lower hollow component and a plurality of vertical hollow components along the length of the upper and lower components and unitarily coupling the upper and lower components with the space within the components in communication one with another.

3. A crib comprising:

a blow molded headboard panel vertically positioned and constituting the head end of the crib;

a blow molded footboard panel vertically positioned and constituting the foot end of the crib with the footboard being essentially parallel with the headboard and with a space therebetween; and a pair of blow molded side panels with each of the side panels vertically positioned and spaced in parallel relationship with respect to each other and with the ends of the side panels removably coupled with respect to the ends of the headboard and footboard to form a generally box-like configuration, each of the panels including a single continuous opening therewithin.

4. The crib as set forth in claim 3 wherein the crib is fabricated of a high density polyethylene.

5. The crib as set forth in claim 3 wherein each of the panels has an aperture adjacent to the lower extent thereof for the application of pressurized fluid during the fabrication thereof.

6. A crib comprising:

a blow molded headboard panel, vertically positionable at the head end of the crib bed; a blow molded footboard, vertically positionable at the foot end of the crib bed, the footboard being essentially parallel with the headboard and with a space therebetween; and a pair of blow molded side rail panels, each of the side rail panels vertically positionable spaced in parallel relationship with respect to each other with the ends of the side rail panels removably coupled with respect to the ends of the headboard and footboards in a generally box-like configuration; and a plurality of projections extending upwardly from the upper components of the side rail panels constituting a teething surface for a child within the crib.

7. The crib as set forth in claim 6 wherein the projections extend from adjacent the topmost extent of at least one side rail and extend inwardly toward the interior of the crib for about 45 degrees.

8. The crib as set forth in claim 6 wherein the thickness of the material in the panels is about 0.100 inches, the projections extend upwardly a distance of about 0.020 inches and the projections have a spherical exterior surface having a radius of about 0.090 inches.

9. The crib as set forth in claim 6 and further including a plurality of decorative indicia molded into the exterior surface of at least one of the panels with associated regions for receiving insert panels for the application of supplemental indicia.

10. A crib comprising:

a blow molded headboard panel, vertically positionable at the head end of the crib bed; a blow molded footboard, vertically positionable at the foot end of the crib bed, the footboard being essentially parallel with the headboard and with a space therebetween; and a pair of blow molded side rail panels, each of the side rail panels including vertical components positioned and spaced in parallel relationship with respect to each other with the ends of the side rail panels removably coupled with respect to the ends of the headboard and footboards in a generally box-like configuration;

adjustment components located within the upper region of at least one of the side panels and extending downwardly through one vertical component at the end of the side panel with a latch positionable between a retracted position within such vertical component and an extended position exterior thereof for coupling with an aperture in the adjacent headboard and footboard panels.

11. The crib as set forth in claim 10 wherein the adjustment components include a pivotable latch mounted on a pivot pin fixedly secured to a side panel with a wire having a coil spring along its length for coupling the lever to a portion of the adjustment components within the upper region of the associated side panel and a resilient member for urging the lever to a locked position.

12. A new and improved crib comprising, in combination:

a blow molded headboard panel vertically positioned and constituting the head end of the crib, a blow molded footboard panel vertically positioned and constituting the foot end of the crib with the footboard being essentially parallel with the headboard and with a space therebetween, a pair of blow molded side panels with each of the side panels vertically positioned and spaced in parallel relationship with respect to each other and with the ends of the side panels removably coupled with respect to the ends of the headboard and footboard to form a generally box-like configuration and with each of the panels being fabricated by blow molding to form a horizontal upper hollow component and a horizontal lower hollow component and a plurality of vertical hollow components coupling the upper and lower components with the space within the components in communication one with another; and vertically disposed projections extending outwardly from the opposed vertical edges of the side rail panels and formed integrally therewith and complementary recesses formed in the adjacent vertical edge of the end panels and formed integrally therewith.

13. The crib as set forth in claim 12 wherein the recesses are formed with vertical spaces along their lengths and of lengths less than the vertical length of the projections.

14. A new and improved crib comprising, in combination:

a blow molded headboard panel vertically positioned and constituting the head end of the crib, a blow molded footboard panel vertically positioned and constituting the foot end of the crib with the footboard being essentially parallel with the headboard and with a space therebetween, a pair of blow molded side panels with each of the side panels vertically positioned and spaced in parallel relationship with respect to each other and with the ends of the side panels removably coupled with respect to the ends of the headboard and footboard to form a generally box-like configuration and with each of the panels being fabricated by blow molding to form a horizontal upper hollow component and a horizontal lower hollow component and a plurality of vertical hollow components coupling the upper and lower components with the space within the components in communication one with another;

a horizontally positioned mattress support with mechanisms for raising and lowering the height of the mattress support, such mechanisms including vertical members of a resilient material positionable in a vertical orientation secured at their upper edges to the headboard and footboard member with each vertical member having an inwardly directed projection positionable in any of a plurality of apertures in the headboard and footboard with a keeper member slidable vertically along at least a portion of the length of the vertical member whereby when in the lower position it will maintain its associated projection in an associated aperture and when in the raised position it will allow the flexing of the resilient member to withdraw the projection from its aperture to allow sliding of the keeper member and mattress support to any of a plurality of elevational orientations corresponding to the aperture receiving the projection.

* * * * *